US005433795A

United States Patent [19]

Panchanathan et al.

[11] Patent Number: 5,433,795

[45] Date of Patent: Jul. 18, 1995

[54] FABRICATION OF PERMANENT MAGNETS WITHOUT LOSS IN MAGNETIC PROPERTIES

[75] Inventors: Viswanathan Panchanathan, Anderson; John E. Mason, East Markleville, both of Ind.

[73] Assignee: General Motors Corporation, Detroit, Mich.

[21] Appl. No.: 122,983

[22] Filed: Sep. 20, 1993

[51] Int. Cl.[6] ..... H01F 1/057

[52] U.S. Cl. ..... 148/101; 148/102; 148/121

[58] Field of Search ..... 148/101, 102, 120, 121

[56] References Cited

U.S. PATENT DOCUMENTS 4,900,374 2/1990 Panchanathan ..... 148/101

*Primary Examiner*—John Sheehan

*Attorney, Agent, or Firm*—George A. Grove

[57] ABSTRACT

A method is provided for forming high coercivity permanent magnets from a rare earth-iron-boron metal, wherein the permanent magnets exhibit high intrinsic coercivity comparable to that of the rare earth-iron-boron metal alloy when formed by machining and appropriately heat treating the metal alloy in air at a temperature greater than the Curie temperature of the material, prior to or after the machining operation. As a result, high coercivity permanent magnets can be selectively sized and shaped to satisfy specific design requirements, without requiring that a punch and die be specially designed and manufactured to produce the permanent magnets. The heat treatment method is able to promote machinability of the metal alloy without substantially causing a loss in magnetic properties. Alternatively, the heat treatment method can be employed to substantially restore the magnetic properties of a permanent magnet which were previously reduced by conventional annealing practices.

12 Claims, 2 Drawing Sheets

FABRICATION OF PERMANENT MAGNETS WITHOUT LOSS IN MAGNETIC PROPERTIES

The present invention generally relates to the making and machining of high coercivity permanent magnets based primarily on iron, neodymium and/or praseodymium, and boron. More specifically, this invention relates to a method by which a hot worked rare earth-iron-boron magnetic body can be machined without experiencing a significant loss in magnetic properties resulting from the conventional anneal prior to machining, such that a permanent magnet can be formed to have a desired shape and size and yet substantially maintain the original magnetic properties, such as intrinsic coercivity and remanence, of the parent hot worked magnetic body. Alternatively, the heat treatment method can be employed to substantially restore the magnetic properties of a permanent magnet which were previously reduced by conventional annealing practices.

BACKGROUND OF THE INVENTION

Permanent magnets based on compositions containing iron, neodymium and/or praseodymium, and boron are known and in commercial usage. Such permanent magnets contain, as an essential magnetic phase, grains of tetragonal crystals in which the proportions of, for example, iron, neodymium and boron are exemplified by the empirical formula $Nd_2Fe_{14}B$. These magnet compositions and methods for making them are described by Croat in U.S. Pat. No. 4,802,931 issued Feb. 7, 1989. The grains of the magnetic phase are surrounded by a second phase that is typically rare earth-rich, as an example neodymium-rich, as compared with the essential magnetic phase. It is known that permanent magnets based on such compositions may be prepared by rapidly solidifying, such as by melt spinning, a melt of the composition to produce fine grained, magnetically isotropic platelets of ribbon-like fragments. Magnetically isotropic magnets may be formed from these isotropic particles by practices which are known, such as by bonding the particles together with a suitable resin.

To improve magnetic properties, it is known to hot press the isotropic particles to form an isotropic magnetic body and then hot work the isotropic magnetic body to create high strength, magnetically anisotropic permanent magnets, as taught by U.S. Pat. No. 4,782,367 to Lee. Being magnetically anisotropic, such magnets exhibit excellent magnetic properties, typically having high remanence and a magnetic coercivity of about one kiloOersted (kOe) or higher.

However, a shortcoming of such anisotropic magnets is that, because the final forming step is a hot working operation, the shapes in which the anisotropic magnets can be formed are significantly limited, particularly in comparison to the great variety of shapes which are possible with bonded magnets. Furthermore, even if an uncomplicated shape is required for a particular application, it is generally economically undesirable to fabricate a special punch and die for each application which arises, particularly when the magnet is intended for evaluation in a development program, as opposed to a full scale production program. Such an approach is also undesirable from the standpoint of lead time, particularly when there is an immediate requirement in a development program for a permanent magnet whose size is currently unavailable.

As a result, it is a common practice in the art to form large anisotropic magnets and then machine these magnets to form smaller magnet bodies which are sized and shaped to meet the requirements of a particular application. Many methods are known for machining the smaller magnet bodies from the larger anisotropic magnets, with electrical discharge machining (EDM) being the most common technique, although other methods such as using a diamond cutting wheel or other appropriate material are also employed to machine the magnets. However, because such anisotropic magnets are formed by a hot working operation, these magnets are generally characterized as being hard and brittle. As a result, it is a conventional practice to anneal these magnets prior to machining to enhance their machinability. Typically, annealing is conducted at a temperature of about 350° C. for a duration of at least about eight hours. While this operation successfully serves to promote the machinability of the magnets, an undesirable loss in magnetic properties occurs.

FIG. 1 illustrates the degree to which the magnetic properties of a magnetically anisotropic magnet may be reduced when the above annealing operation is employed. Curve A represents the initial demagnetization curve for an anisotropic permanent magnet having a composition, on a weight percent basis, of about 30.5 percent rare earth, about 2.5 percent cobalt, about 1 percent boron, with the balance being essentially iron. The x-axis represents intrinsic coercivity in kilo-oersteds (kOe), the y-axis represents remanence in kilogauss (kG), and the series of parallel curves numbered 20 through 36 demarcate the energy product (BHmax) in megagauss-oersteds (MGOe). Prior to annealing, the remanence, or residual induction, ($B_r$) of the magnet was about 12.7 kG, while its intrinsic coercivity ($H_{ci}$) was about 13.3 kOe. Curve B represents the demagnetization curve for the permanent magnet after having been annealed at about 350° C. for about eight hours. While remanence remained essentially the same, a significant reduction in intrinsic coercivity occurred, from about 13.3 kOe to about 10.6 kOe. Though such lower intrinsic coercivities are sufficiently high for numerous applications, more demanding applications often cannot be fulfilled with a permanent magnet having an intrinsic coercivity at this level.

From the above, it can be seen that there does not currently exist a suitable method by which a magnetically anisotropic magnet can be readily machined to fulfill a specific application without the magnet produced exhibiting magnetic properties which have been significantly reduced from that of the parent magnet. Therefore, what is needed is a method by which a permanent magnet can be fabricated from a larger permanent magnet without a significant loss in magnetic properties occurring, wherein the method is compatible with conventional machining techniques by which smaller, more intricately shaped magnets can be fabricated from larger, hot worked magnets.

SUMMARY OF THE INVENTION

It is an object of this invention to provide a method for fabricating a permanent magnet from a larger permanent magnetic body, wherein the magnet produced exhibits magnetic properties which are similar to that of the larger permanent magnetic body.

It is a further object of this invention that, in one embodiment, such a method entail annealing and then machining the larger permanent magnetic body to form a permanent magnet, wherein the method involves heat treating the permanent magnet so as to substantially restore the magnetic properties thereof to a level comparable to that of the larger permanent magnetic body.

It is another object of this invention that, in a second embodiment, such a method entail performing the heat treatment prior to machining the larger permanent magnet body, wherein the heat treatment promotes the machinability of the anisotropic permanent magnet body without causing a reduction in its magnetic properties.

It is another object of this invention that such a heat treatment be compatible with conventional processing practices, wherein the heat treatment is conducted at temperatures and for durations which can be readily implemented under prototype and production manufacturing conditions.

It is still another object of this invention that such anisotropic magnets have a composition whose magnetic constituent is the tetragonal crystal phase $RE_2TM_{14}B$, based primarily on neodymium and/or praseodymium, iron and boron.

In accordance with a preferred embodiment of this invention, these and other objects and advantages are accomplished as follows.

According to the present invention, it has been determined that a high coercivity anisotropic permanent magnet can be formed from suitable permanent magnet alloys by heat treating the magnetic alloys prior to or after machining. More specifically, though the magnetic properties of a magnetic alloy are reduced by conventional annealing processes prior to machining, heat treating the resulting magnet after machining in accordance with this invention serves to restore the magnetic properties of the magnet to a level substantially equal to or higher than that of the magnetic alloy from which the magnet was machined.

In addition, it has been determined that substituting the heat treatment technique of this invention for the conventional annealing process of the prior art substantially avoids any losses in magnetic properties of the magnetic alloy, while sufficiently promoting the machinability of the magnetic alloy such that magnets can be successfully machined therefrom. Furthermore, a substantial cost savings may be realized if a single heat treatment step is used to enhance machinability while retaining the magnetic properties, prior to machining, in accordance with one of the preferred methods of this invention.

The processing method of this invention is particularly suitable for producing magnetically anisotropic permanent magnets from magnetically anisotropic alloy bodies which have been hot pressed and plastically deformed to enhance their magnetic properties. Accordingly, an anisotropic permanent magnet can be specifically machined to a desired size and shape so as to fulfill a specific prototype or production application, instead of requiring that a specially designed punch and die be fabricated to produce the anisotropic permanent magnet.

Generally, the preferred magnet composition of this invention comprises, on an atomic percentage basis, about 40 to 90 percent of iron or mixtures of cobalt and iron, about 10 to 40 percent of rare earth metal that necessarily includes neodymium and/or praseodymium, and at least about one-half percent boron. Preferably, iron makes up at least about 40 atomic percent of the total composition and neodymium and/or praseodymium make up at least about 6 atomic percent of the total composition. Also, preferably, the boron content is in the range of about 0.5 to about 10 atomic percent of the total composition, but the total boron content may suitably be higher than this, depending on the intended application. It is further preferred that iron make up at least 60 atomic percent of the non-rare earth metal content, and that the neodymium and/or praseodymium make up at least about 60 atomic percent of the rare earth content.

Although the specific examples of this invention are given in weight percents which fall within the above-described atomic percents, it is noted that the compositions of the various iron, rare earth, boron and cobalt constituents may vary greatly within the preferred atomic ranges specified above.

Other metals may also be present in minor amounts of up to about one weight percent, either alone or in combination. These metals include tungsten, chromium, nickel, aluminum, copper, magnesium, manganese, gallium, niobium, vanadium, molybdenum, titanium, tantalum, zirconium, carbon, tin and calcium. Silicon is also typically present in small amounts, as are oxygen and nitrogen.

The method of this invention includes providing a rare earth-iron-boron magnetic body, which in a preferred embodiment has been hot pressed and hot worked to form an anisotropic magnetic body having a magnetic coercivity of preferably greater than about 1 kOe, and typically greater than about 10 kOe. It is from this magnetic body that one or more smaller permanent magnets are to be produced using conventional fabricating techniques, such as electrical discharge machining.

The method of this invention encompasses alternative techniques for producing a permanent magnet having magnetic properties which are substantially equal to or greater than the magnetic properties of the anisotropic magnetic body from which it is formed.

In accordance with a first preferred technique, the anisotropic magnetic body is subjected to a conventional annealing process in air at about 350° C. for a duration of at least about eight hours so as to promote the machinability of the anisotropic magnetic body. As a result of this annealing process, the magnetic properties of the magnetic body are significantly reduced. The desired permanent magnet is then machined from the magnetic body in accordance with the size and shape requirements for its particular application. Thereafter, the permanent magnet is heat treated in air at a temperature greater than the Curie temperature of the material, which is strongly dependent on composition, yet a temperature which does not result in excessive grain growth, such as from about 400° C. and about 760° C. for a duration of about 1 to about 60 minutes, most preferably from about 5 to about 30 minutes. In accordance with this invention, such a heat treatment serves to restore the magnetic properties of the permanent magnet to levels substantially equal to or greater than that of the anisotropic magnetic body.

It is believed that the preferred heat treatment must be at a temperature equal to or greater than the Curie temperature of the material, which is dependent on the composition of the material. For the tetragonal $Nd_2Fe_{14}B$ phase, the Curie temperature is approximately 305° C. Therefore, a heat treat temperature of at least about 400° C. or greater is preferred to ensure suitable results. However, the heat treatment temperature must not be too great, so as to cause undesirable excessive grain growth, which may diminish the magnetic properties of the material. Typically, the length of the hot worked tetragonal $Nd_2Fe_{14}B$ grains range from about 100 to about 500 nanometers, which a length of about 100 to about 400 nanometers being preferred. Excessive grain growth reduces the magnetic properties of the material; therefore, it is preferred that the heat treatment not cause the grains to exceed one micron in length. Most preferably, the grains should not exceed 500 nanometers in length. Thus, it is believed that a maximum temperature of about 760° C. is sufficient. Accordingly, the duration at the various temperatures will also affect the heat treatment results.

Alternatively, and in accordance with a second preferred technique of this invention, the anisotropic magnetic body is subjected to the above-described heat treatment in air of between about 400° C. and about 760° C. and for a duration of about 1 to about 60 minutes, most preferably about 5 to about 30 minutes, prior to being machined. It has been unexpectedly determined that such a heat treatment serves to promote the machinability of the anisotropic magnetic body, in lieu of the conventional annealing operation at 350° C. As a result, the magnetic properties of the anisotropic magnetic body are not significantly reduced prior to machining. The desired permanent magnet can then be machined from the magnetic body in accordance with the size and shape required for its particular application. As a result, the permanent magnet formed in accordance with this invention exhibits magnetic properties at levels substantially equal to or greater than that of the anisotropic magnetic body. In addition, by utilizing a single heat treatment step to enhance both the machinability of the permanent magnet and the magnetic properties, lower production and associated costs are realized.

With the heat treatment techniques of this invention, it has been determined that anisotropic permanent magnets can be produced by machining a larger magnetically anisotropic alloy body, such that the resulting permanent magnets have magnetic properties, and in particular, intrinsic coercivities, substantially equal to that of the magnetically anisotropic alloy body. Such a result is in contrast to the teachings of the prior art, which teaches that reduced magnetic properties unavoidably result due to the requirement for annealing such alloy bodies prior to machining.

Accordingly, an advantage of the present invention is that high coercivity permanent magnets can be produced for specific prototype and production applications, without the requirement that a punch and die be specially designed to form an anisotropic permanent magnet having the desired size and shape for the application. As a result, the method of this invention is able to produce high coercivity permanent magnets at a cost which is potentially lower than would be otherwise required to produce a permanent magnet of comparable magnetic properties. Furthermore, because a punch and die need not be specially designed for a given application, the lead time to produce a permanent magnet for a given application is relatively short, in that permanent magnets can be fabricated from magnetically anisotropic alloy bodies produced in relatively standardized sizes. As such, a permanent magnet can be readily tailored to meet the particular needs of a given application.

Other objects and advantages of this invention will be better appreciated from the following detailed description.

BRIEF DESCRIPTION OF THE DRAWINGS

Reference will be made to the accompanying drawings wherein.

DETAILED DESCRIPTION OF THE INVENTION

Figure 1:
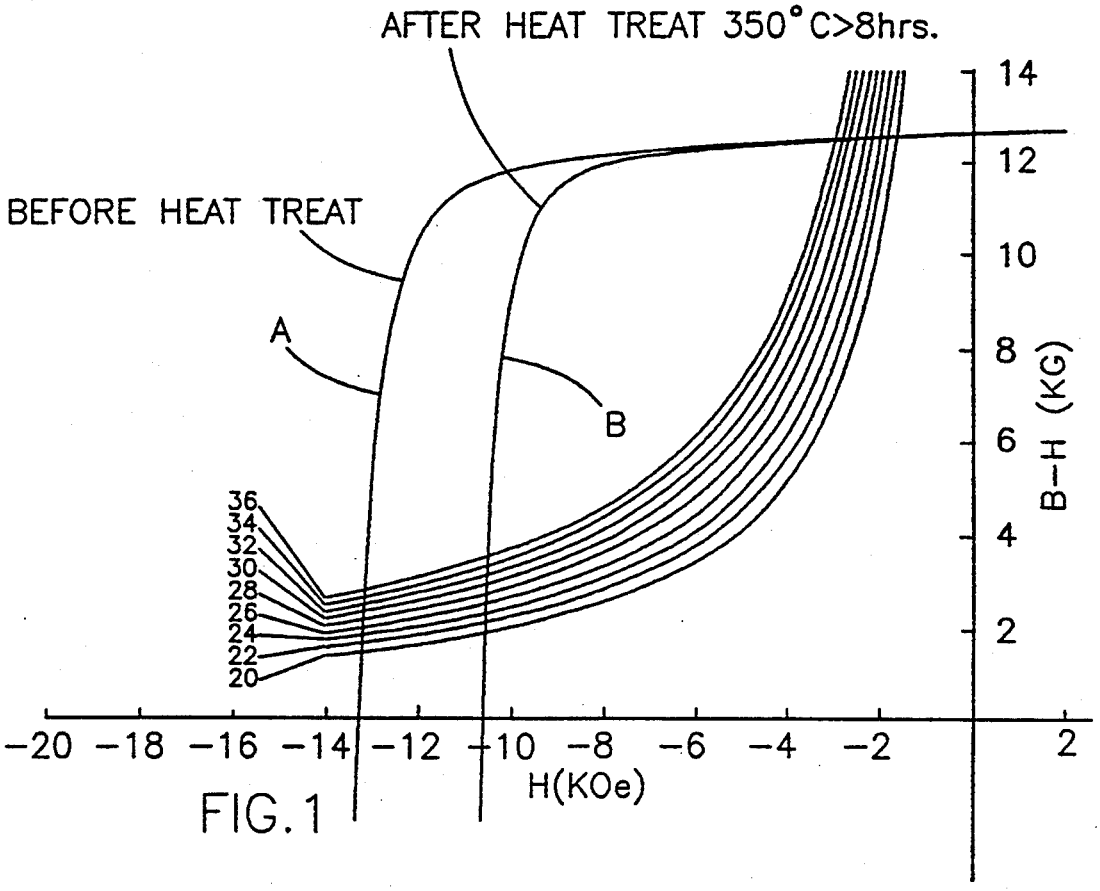
FIG. 1 illustrates the demagnetization curves for a magnetically anisotropic permanent magnet before and after annealing at about 350° C. for about eight hours in accordance with conventional practices known in the prior art.

The preferred method of the present invention forms permanent magnets, and more preferably magnetically anisotropic permanent magnets, from a rare earth-iron-boron metal alloy, wherein the permanent magnets exhibit high intrinsic coercivity comparable to that of the rare earth-iron-boron metal alloy when formed by machining and appropriately heat treating the metal alloy prior to or after the machining operation. As a result, magnetically anisotropic permanent magnets exhibiting high coercivity can be selectively sized and shaped to satisfy specific design requirements without requiring that a punch and die be specially designed and manufactured to produce the permanent magnet. The method of this invention generally involves subjecting the metal alloy to a heat treatment which is sufficient to promote machinability without substantially causing a loss in magnetic properties, or which is sufficient to substantially restore the magnetic properties of a permanent magnet which were previously reduced by conventional annealing practices.

More specifically, the method of this invention includes a heat treatment process which is preferably conducted in air, although other suitable atmosphere could be used such as an inert atmosphere, at temperatures greater than the Curie temperature of the composition, but less than a temperature which may cause excessive grain growth within the material, such as between about 400° C. and about 760° C. The heat treatment can be performed after the rare earth-iron-boron metal alloy has been annealed and machined to form one or more permanent magnets for the purpose of substantially restoring the magnetic properties of the permanent magnets to levels comparable to or greater than that of the metal alloy. Alternatively, the heat treatment can be performed in lieu of the conventional annealing operation typically performed prior to machining of the metal alloy for the purpose of substantially preventing a reduction in the magnetic properties of the metal alloy while promoting the machinability of the metal alloy. With either method, the result is the fabrication of a permanent magnet which exhibits magnetic properties that are substantially equal to or greater than that of the metal alloy.

Appropriate compositions for the rare earth-iron-boron metal permanent magnet of this invention include a suitable transition metal component, a suitable rare earth component and boron, as well as small additions of cobalt, and are generally represented by the empirical formula $RE_2TM_{14}B$. The preferred compositions consist of, on an atomic percentage basis, about 40 to 90 percent of iron or mixtures of cobalt and iron, with the iron preferably making up at least 60 percent of the non-rare earth metal content; about 10 to 40 percent of rare earth metal that necessarily includes neodymium and/or praseodymium, with the neodymium and/or praseodymium preferably making up at least about 60 percent of the rare earth content; and at least one-half percent boron. Preferably, iron makes up at least about 40 atomic percent of the total composition and the neodymium and/or praseodymium make up at least about six atomic percent of the total composition. The boron content is preferably in the range of about 0.5 to about 10 atomic percent of the total composition, but the total boron content may suitably be higher than this depending on the intended application for the magnetic composition. Useful permanent magnet compositions suitable for practice with this invention are specified in U.S. Pat. No. 4,802,931 to Croat issued Feb. 7, 1989.

It is to be noted that other metals may also be present in minor amounts of up to about one weight percent, either alone or in combination, such as tungsten, chromium, nickel, aluminum, copper, magnesium, manganese, gallium, niobium, vanadium, molybdenum, titanium, tantalum, zirconium, carbon, tin and calcium. Silicon, oxygen and nitrogen will also usually be present in small amounts.

Specific compositions which have been useful in preparing hot worked, anisotropic permanent magnets of this type, in corresponding weight percentages, are as follows and contain the magnetic phase consisting of $Nd_2Fe_{14}B$ (or the equivalent) tetragonal crystals; about 26 to about 32 percent rare earth (wherein at least about 95 percent of this constituent is neodymium and the remainder is essentially praseodymium); about 0.7 to about 1.1 percent boron; and the balance being iron with cobalt being substituted for the iron in some instances from about 2 to about 16 percent. While the preferred composition necessarily contains iron, neodymium and/or praseodymium, and boron, the presence of cobalt is optional. The composition may also contain other constituents providing that the isotropic and anisotropic particles contain the magnetic phase $RE_2TM_{14}B$ along with at least one additional phase at the grain boundaries that is richer in rare earth. In the essential magnetic phase, TM is preferably at least about 60 percent iron and RE is preferably at least about 60 percent neodymium and/or praseodymium.

However, it should be understood that the teachings of this invention are applicable to the larger family of compositions as described previously in atomic percentages and will be referred to generally as an iron-neodymium-boron composition.

Generally, permanent magnetic bodies of this composition are formed by starting with magnetically isotropic alloy ingots. Such ingots are reduced to particles from which an anisotropic body can be formed, in accordance with methods known in the prior art, by hot pressing and hot working the isotropic particles. The hot working process involves plastically deforming the individual grains of the isotropic particles so as to significantly enhance their magnetic properties. As an example of such a method, anisotropic magnetic bodies are produced by first melting the alloy ingots by induction heating under a dry, substantially oxygen-free argon, inert or vacuum atmosphere to form a uniform molten composition. Preferably, the molten composition is then rapidly solidified to produce an amorphous material or a finely crystalline material. It is most preferred that the rapidly solidified material be amorphous or, if extremely finely crystalline, have a grain size smaller than about 20 nanometers. Such material may be produced, for example, by conventional melt spinning operations. Conventionally, the substantially amorphous, or finely crystalline, melt-spun ribbons are then milled to a powder.

The powder, which is magnetically isotropic at this point, is then hot pressed at a sufficient pressure and duration to form a fully dense material. Conventionally, this is achieved by heating the composition to a suitable temperature in a die and compacting the composition between upper and lower punches so as to form a substantially fully dense, flat cylindrical plug. Typically, when melt-spun material finer than about 20 nanometers in grain size is heated at such an elevated temperature for a period of a minute or so and hot pressed to full density, the resultant body is a permanent magnet. Further, the magnetic body is slightly magnetically anisotropic, i.e., the magnetic body has a preferred direction of magnetization. If the particulate material has been held at the hot pressing temperature for a suitable period of time, it will then have a grain size in the range of about 20 to about 500 nanometers, preferably about 20 to 100 nanometers.

The hot pressed body is then hot worked—that is, plastically deformed at such an elevated temperature so as to deform the grains. The resultant magnetic product displays appreciable magnetic anisotropy. The hot working step is typically carried out in a larger die, also at an elevated temperature, in which the hot pressed body is die upset to form the desired shape. The resultant magnet is hard and strong, characterized by a density of typically about 7.5 grams per cubic centimeter, which is substantially full density.

If suitably practiced, the high temperature working produces a fine platelet microstructure, generally without affecting an increase in grain size above about 500 nanometers. Care is taken to cool the material before excessive grain growth and loss of intrinsic coercivity occurs. The preferred direction of magnetization of the hot worked product is typically parallel to the direction of pressing and transverse to the direction of plastic flow. Significantly higher intrinsic coercivities are obtained when the body is magnetically aligned transverse to the direction of plastic flow. It is not uncommon for the hot worked product to have intrinsic coercivities of at least about 1 kOe, and more typically at least about 10 kOe or higher.

The hot worked, die upset body is unmagnetized, magnetically anisotropic, and has an appreciable magnetic coercivity. By die upsetting, the grains in the body are flattened and aligned with their major dimension lying transverse to the direction of pressing. The maximum dimensions of the grains are preferably less than about 500 nanometers, and typically in the range of about 100 to 400 nanometers. The grains contain tetragonal crystals in which the proportions of iron, neodymium and boron are in accordance with the formula $Nd_2Fe_{14}B$.

The actual temperatures employed to hot press and hot work the bodies can typically vary between about 700° C. and about 850° C. Because the hot pressing and hot working processes are not specifically a feature of this invention, these processing parameters will not be discussed in detail. Generally, the hot pressing and hot working are accomplished at the same elevated temperature, although this is not necessary.

In accordance with this invention, the anisotropic body is then machined to form a smaller permanent magnet which can be specifically sized and shaped for a particular application. The method encompasses a heat treatment step either before or after the anisotropic body is machined, both methods being capable of forming a magnetically anisotropic permanent magnet having magnetic properties which are substantially the same as that of the anisotropic body. Such a result is in direct contrast to that achieved in the prior art.

As noted previously, FIG. 1 is illustrative of the degree to which the magnetic properties of an anisotropic body might be reduced in accordance with prior art practices. Generally, because anisotropic bodies formed in accordance with the above process are characterized as being hard, strong and full density, such anisotropic bodies are relatively brittle and therefore difficult to machine. Accordingly, it has been a conventional practice to anneal these anisotropic bodies to promote their machinability. An example of an annealing technique practiced in the prior art involves heating the anisotropic body to a temperature of about 350° C. for a duration of at least about eight hours. Conventional annealing practices involve heating at a temperature ranging from about 300° C. to about 400° C. for one to 24 hours. While such a step suitably enhances the machinability of the anisotropic body, a significant reduction in magnetic properties results.

The anisotropic body whose magnetic properties are represented in FIG. 1 contained the magnetic phase consisting of $Nd_2Fe_{14}B$ (or the equivalent) tetragonal crystals and was composed of about 30.5 weight percent rare earth (wherein at least about 95 percent of this constituent was neodymium and the remainder was essentially praseodymium), about 2.5 weight percent cobalt, about 1 weight percent boron, with the balance being iron. The anisotropic body was processed in accordance with the above to form an approximately 1.5 by 1.5 by 0.5 inch block. The magnetic properties of the anisotropic body were then determined using a hysteresisgraph magnetometer, in accordance with known practices. Curve A represents the demagnetization curve for the anisotropic body prior to annealing, while Curve B represents the demagnetization curve for the anisotropic body after annealing at approximately 350° C. for eight hours. A considerable loss in the intrinsic coercivity ($H_{ci}$) can be seen from the graph (a decrease from about 13.3 to about 10.6 kOe). Though the remanence remained substantially the same, degradation of this property may also result as a consequence of annealing.

In accordance with this invention, such losses in magnetic properties are substantially avoided through either restoring the magnetic properties of the anisotropic body by performing the preferred heat treatment after machining or through substituting the preferred heat treatment for the conventional annealing step prior to machining. Specifically, the preferred heat treatment is conducted at a temperature of between about 400° C. and about 760° C., and more preferably between about 590° C. and about 700° C. The processing steps and properties achievable by the method of this invention will be better appreciated through a discussion of the specific examples provided below.

EXAMPLE 1

Two magnetically anisotropic bodies were formed in accordance with the conventional practice described above as blocks measuring approximately 1.5 by 1.5 by 0.5 inches. Each body was composed of about 30.5 weight percent rare earth (wherein at least about 95 percent of this constituent is neodymium and the remainder is essentially praseodymium), about 2.5 weight percent cobalt, and about 1 weight percent boron, with the balance being iron. The initial remanence for each sample, identified as Samples 1 and 2, was about 12.6 kG, while their initial intrinsic coercivities were about 13.0 kOe.

Figure 2:
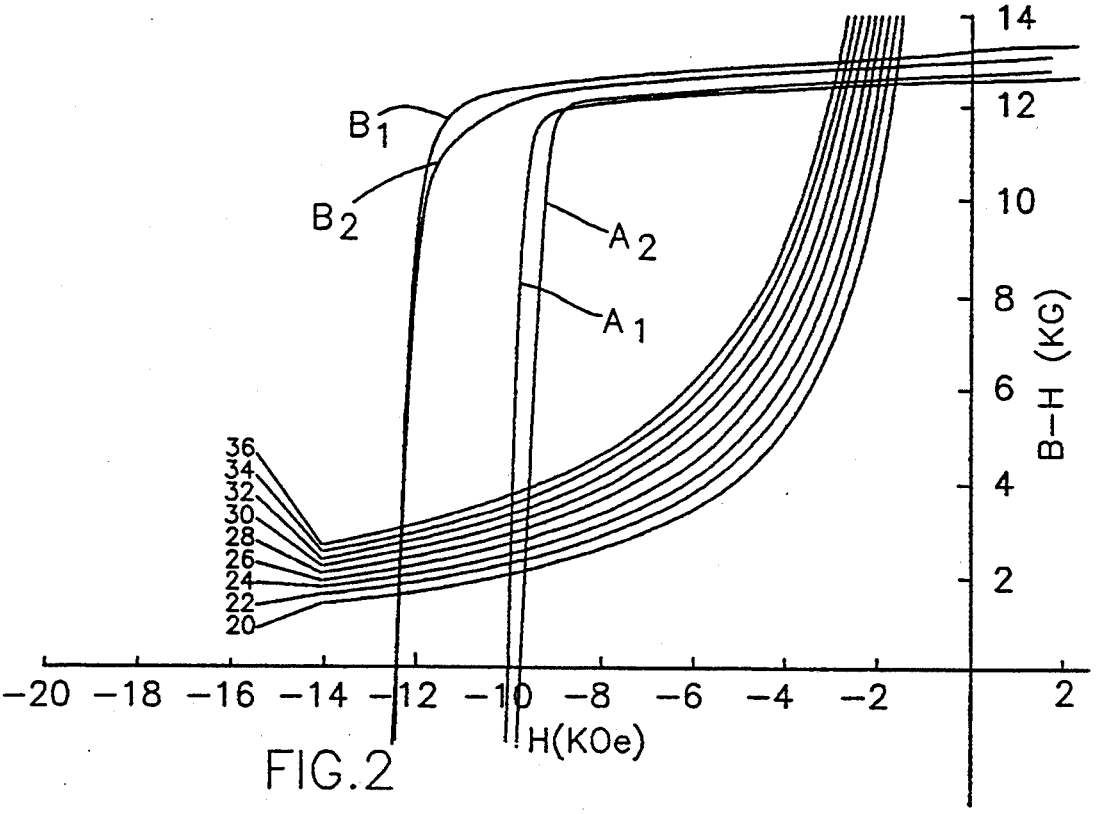
FIG. 2 illustrates the demagnetization curves for a pair of magnetically anisotropic permanent magnets after being annealed at about 350° C. for about eight hours, and then after being heat treated at either about 590° C. or about 700° C. for 10 minutes in accordance with this invention.

Each sample was annealed in air at about 350° C. for about eight hours so as to enable machining of the bodies. Sample 1 was machined to form an approximately 1 by 1 by $\frac{1}{4}$ inch magnet using conventional EDM techniques, while Sample 2 was machined to form an approximately $\frac{3}{4}$ by $\frac{3}{4}$ by 0.11 inch magnet. Curves $A_1$ and $A_2$ Of FIG. 2 represent the demagnetization curves for Samples 1 and 2, respectively, after annealing and machining. Curve $A_1$ indicates a drop in intrinsic coercivity from about 13.0 kOe to about 10.0 kOe and a drop in remanence from about 12.6 kG to about 12.2 kG for Sample 1. For Sample 2, Curve $A_2$ indicates a drop in intrinsic coercivity from about 13 kOe to about 9.7 kOe, with remanence remaining at about 12.6 kG.

The magnets were then heated in air to a temperature of about 700° C. and 590° C., respectively, for a duration of about 10 minutes and again retested, the results of which can be seen as Curves $B_1$ and $B_2$, respectively, in FIG. 2. It is apparent from these curves that a substantial increase in both remanence and intrinsic coercivity occurred in both samples. More specifically, the remanences and intrinsic coercivities of Samples 1 and 2 are very nearly identical to or higher than that of the anisotropic bodies from which they were machined. Curve $B_1$ indicates that the intrinsic coercivity for Sample 1 was increased to about 12.5 kOe and remanence was increased to about 12.9 kG. Sample 2 also exhibited an increase in intrinsic coercivity to about 12.5 kOe, with remanence increasing to about 12.8 kG. The above results are indicative of the ability of the heat treatment technique of this invention to substantially restore the original magnetic properties of the anisotropic bodies from which the permanent magnets were machined.

EXAMPLE 2

Figure 3:
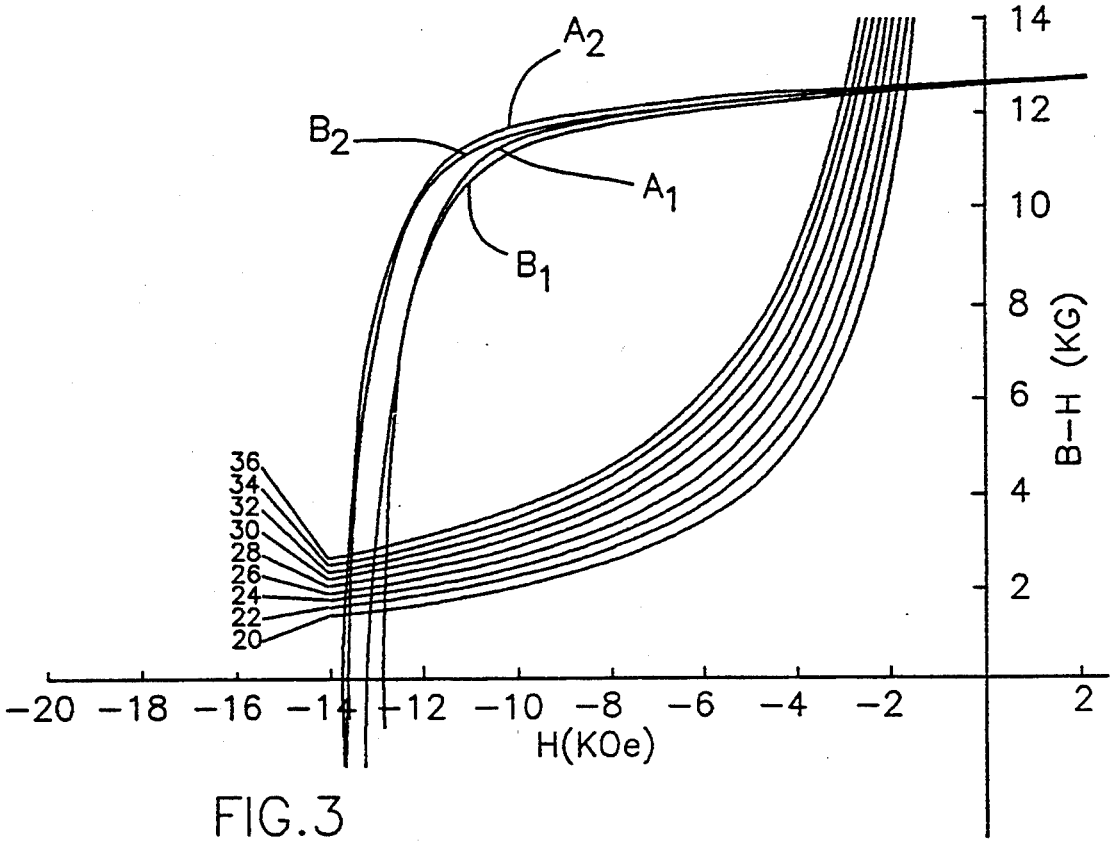
FIG. 3 illustrates the demagnetization curves for a pair of magnetically anisotropic permanent magnets before and after being heat treated at about 760° C. for 10 minutes in accordance with this invention.

Two magnetically anisotropic bodies were formed in accordance with the samples of Example 1. The initial magnetic properties of the anisotropic bodies are indicated by their demagnetization curves, illustrated as Curves $A_1$ and $A_2$ in FIG. 3. Each body was heat treated in air at about 700° C. for about 10 minutes in accordance with this invention, so as to evaluate the ability of the heat treatment to promote the machinability of the bodies. After heat treatment, the magnetic properties of the anisotropic bodies were again determined and are represented by the demagnetization Curves $B_1$ and $B_2$, respectively, in FIG. 3. As is apparent from the results, both intrinsic coercivity and remanence were substantially the same before and after heat treating.

Figure 4:
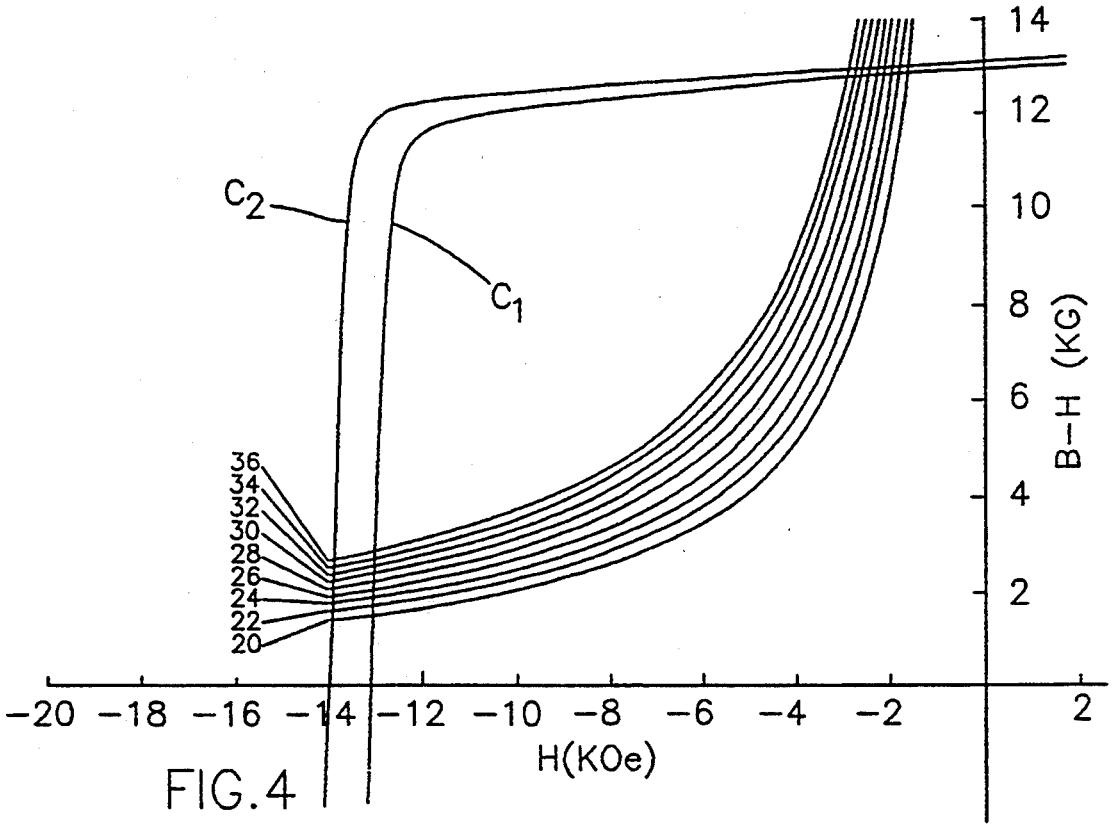
FIG. 4 illustrates the demagnetization curves for a pair of permanent magnets which were machined from the heat treated, magnetically anisotropic permanent magnets of FIG. 3.

Without undergoing the conventional 350° C. annealing step, an approximately 1 by 1 by ¼ inch magnet was then machined from each body using conventional EDM techniques. The magnetic properties of these magnets were then determined, the results of which are represented by the demagnetization Curves $C_1$ and $C_2$, respectively, in FIG. 4. As is apparent from these results, the intrinsic coercivity and remanence of each magnet were substantially the same as that of the original anisotropic bodies, with a slight increase in remanence being exhibited. More specifically, the above results are indicative of the ability of the heat treatment operation of the invention to substantially prevent the degradation of the original magnetic properties of the anisotropic bodies, while simultaneously enhancing machinability of the bodies so as to permit machining of the bodies to form permanent magnets. In addition, by utilizing a single heat treatment step, lower production and associated costs are realized.

From the above, it can be seen that a particularly advantageous feature of this invention is that a permanent magnet exhibiting high intrinsic coercivity can be machined from a magnetically anisotropic body without a substantial reduction in the magnetic properties of the body. Specifically, in accordance with the heat treating process of this invention, the intrinsic coercivity and remanence of a magnetically anisotropic body either can be substantially restored by heat treating a permanent magnet machined from the body or can be substantially preserved by substituting the heat treatment method of this invention for the annealing operation conventionally employed to enhance machinability of the body. The specific approach adopted for a given application may be chosen on the basis of the particular processing or manufacturing scheme for the given application, whether for developmental or production programs.

In particular, as a result of the heat treatment technique of this invention, high coercivity permanent magnets can be produced for specific prototype and production applications without the requirement that a punch and die be specially designed to achieve the particular size and shape required for the application. As a result, the method of this invention is able to produce high coercivity permanent magnets at a cost which is potentially lower than would be otherwise required to produce a permanent magnet of comparable magnetic properties. Furthermore, because a punch and die need not be specially designed for a given application, the lead time to produce a permanent magnet for a given application is relatively short, in that permanent magnets can be fabricated directly from magnetically anisotropic bodies produced in relatively standardized sizes. As such, a permanent magnet can be readily tailored to meet the particular needs of a given application.

While the preferred embodiments of this invention encompass the initial use of hot worked anisotropic bodies having intrinsic coercivities of at least about 1 kOe or higher, preferably at least about 10 kOe or higher, it is foreseeable that the method of this invention may be equally applicable to the initial use of any rare earth-iron-boron metal body, including ingots and hot pressed bodies.

Therefore, while this invention has been described in terms of a preferred embodiment, it is apparent that other forms could be adopted by one skilled in the art. For example, the composition and magnetic properties of the magnetic bodies from which a permanent magnet is machined could vary from that in the examples, and additional processing steps could be introduced prior to or after the heat treatment taught by this invention. Accordingly, the scope of this invention is to be limited only by the following claims.

The embodiments of the invention in which an exclusive property or privilege is claimed are defined as follows:

1. A method for forming a permanent magnet from a rare earth-iron-boron permanent magnet body such that the magnetic properties of the permanent magnet are substantially equal to that of the rare earth-iron-boron permanent magnet body, the method comprising the steps of:

forming the rare earth-iron-boron permanent magnet body so as to comprise fine grains of the tetragonal crystal phase of $RE_2TM_{14}B$ composition, wherein RE is neodymium and/or praseodymium or mixtures thereof with lesser quantities of other rare earth elements, and TM is iron and mixtures of iron and cobalt, the rare earth-iron-boron magnet body having initial substantially anisotropic magnetic properties;

heating the rare earth-iron-boron permanent magnet body at a temperature greater than the Curie temperature of the $RE_2TM_{14}B$ composition and for a duration of about one to about sixty minutes, which is sufficient to prevent excessive grain growth of the fine grains of the tetragonal phase of the $RE_2TM_{14}B$ composition, yet serves to sufficiently anneal the rare earth-iron-boron permanent magnet body so as to facilitate machining of the permanent magnet, such that the initial anisotropic magnetic properties of the permanent magnet are substantially maintained; and severing the permanent magnet from the rare earth-iron permanent magnet body.

2. A method for forming a permanent magnet as recited in claim 1 wherein said heating step occurs at a temperature of from about 400° C. to about 760° C.

3. A method for forming a permanent magnet as recited in claim 1 wherein the rare earth-iron-boron permanent magnet body has a composition comprising, on a weight percent basis, about 26 to about 32 percent rare earth, optionally about 2 to about 16 percent cobalt, about 0.7 to about 1.1 percent boron, with the balance being essentially iron.

4. A method for forming a permanent magnet as recited in claim 1 wherein the step of heating is conducted at a temperature of about 590° C. to about 700° C. for a duration of about 5 minutes to about 30 minutes.

5. A method for forming a permanent magnet as recited in claim 1 wherein the step of severing is conducted by electrical discharge machining.

6. A method for forming a permanent magnet as recited in claim 1 wherein the permanent magnet is characterized by an intrinsic coercivity of at least about 10 kiloOersteds.

7. A method for forming a permanent magnet, the method comprising the steps of:

forming a rare earth-iron-boron permanent magnet body comprising fine grains of the tetragonal crystal phase of $RE_2TM_{14}B$ composition, wherein RE is neodymium and/or praseodymium or mixtures thereof with lesser quantities of other rare earth elements, and TM is iron and mixtures of iron and cobalt, the permanent magnet having initial substantially anisotropic magnetic properties;

annealing the rare earth-iron-boron permanent magnet body so as to facilitate machining of the rare earth-iron-boron permanent magnet body, such that at least a portion of the initial anisotropic magnetic properties of the rare earth-iron-boron permanent magnet body are diminished;

severing the permanent magnet from the rare earth-iron-boron permanent magnet body; and heating the permanent magnet in air at a temperature greater than the Curie temperature of the $RE_2TM_{14}B$ composition and for a duration sufficient to prevent excessive grain growth of the fine grains of the tetragonal phase of the $RE_2TM_{14}B$ composition, so as to substantially restore the initial substantially anisotropic magnetic properties of the rare earth-iron-boron permanent magnet body to the permanent magnet.

8. A method for forming a permanent magnet as recited in claim 7 wherein the rare earth-iron-boron permanent magnet body has a composition comprising, on a weight percent basis, about 26 to about 32 percent rare earth, optionally about 2 to about 16 percent cobalt, about 0.7 to about 1.1 percent boron, with the balance being essentially iron.

9. A method for forming a permanent magnet as recited in claim 7 wherein the step of severing is conducted by electrical discharge machining.

10. A method for forming a permanent magnet as recited in claim 7 wherein the step of heating is conducted at temperature of from about 400° C. to about 760 ° C.

11. A method for forming a permanent magnet as recited in claim 7 wherein the step of heating is conducted at a temperature of about 590° C. to about 700° C.

12. A method for forming a permanent magnet as recited in claim 7 wherein the permanent magnet is characterized by an intrinsic coercivity of at least about 10 kiloOersteds.

* * * * *